United States Patent [19]

Weidmann et al.

[11] 4,381,803

[45] May 3, 1983

[54] ELECTRONIC WEFT THREAD MONITOR

[75] Inventors: Erich Weidmann, Wetzikon; Alfred Rüegg, Bauma, both of Switzerland

[73] Assignee: Gebrüder Loepfe AG, Wetzikon, Switzerland

[21] Appl. No.: 244,206

[22] Filed: Mar. 16, 1981

[30] Foreign Application Priority Data

Apr. 1, 1980 [CH] Switzerland ..... 2556/80

[51] Int. Cl.[3] ..... D03D 51/34

[52] U.S. Cl. ..... 139/370.2

[58] Field of Search ..... 139/370.2, 370.1; 66/163; 28/187; 57/81; 340/677

[56] References Cited

U.S. PATENT DOCUMENTS

| | | | |
|---|---|---|---|
| 3,916,687 | 11/1975 | Loepfe et al. | 139/370.2 |
| 4,178,590 | 12/1979 | Weidmann | 139/370.2 |
| 4,228,828 | 10/1980 | Loepfe et al. | 139/370.2 |
| 4,256,247 | 3/1981 | Loepfe | 28/187 X |

FOREIGN PATENT DOCUMENTS

| | | | |
|---|---|---|---|
| 546840 | 3/1974 | Switzerland | 139/370.2 |
| 539996 | 2/1977 | U.S.S.R. | 139/370.2 |
| 708003 | 1/1980 | U.S.S.R. | 139/370.2 |

*Primary Examiner*—James Kee Chi

*Attorney, Agent, or Firm*—Werner W. Kleeman

[57] ABSTRACT

A novel electronic weft thread monitor on a gripper shuttle weaving machine of the Sulzer type is designed such as to make possible the continuous monitoring of the weft insertion and the succeeding weft tensioning phases. The weft thread monitor comprises a thread sensing device provided with a guide member and is structured and positioned such as to exhibit a first range of high response sensitivity, and a second range of no or low response sensitivity. The weft thread when sweeping over the guide member is guided from the first to the second range of response sensitivity. When entering this second range, the monitoring process is stopped, and thus the end of the signal indicative of weft travel or tensioning is clearly defined.

4 Claims, 14 Drawing Figures

ELECTRONIC WEFT THREAD MONITOR

BACKGROUND OF THE INVENTION

The present invention refers to a new and improved electronic weft thread monitor on a gripper shuttle weaving machine provided with a picking device, a catch box with means for braking and returning, after weft thread insertion, the gripper shuttle to a defined thread releasing position, and a thread tensioner arranged between a fixed thread guide eye and the picking device and serving for deviating and tensioning the weft thread during the push back motion of the gripper shuttle, the weft thread monitor comprising a sensing device located in the range between the thread guide eye and the thread tensioner, and a switching device for producing a control signal defining the time interval in which the weft thread is monitored.

Weaving machines provided with gripper shuttles, also termed projectiles, are known and in worldwide use. By way of example, a loom of this type is described in Swiss Pat. No. 399,354 (German Pat. No. 1,535,615). There is also disclosed a weft thread monitoring device which responds to the so-called pull after motion of the weft thread occurring in the zone of the thread tensioner during the last phase of the tensioning process, i.e. when the weft or filling thread has been inserted in the weaving shed and is in a tensioned condition.

Further, in Swiss Pat. No. 489,642 there is described an electronic weft thread monitoring device on a gripper shuttle weaving machine, comprising a thread sensing device or sensing head arranged in the zone of the thread tensioner. This device serves for monitoring the weft insertion into the weaving shed within a so-called control interval defined by particular control circuitry. It is imperative to confine the monitoring process to such a control interval since otherwise the weft sensing signal furnished by the sensing head and disappearing at the end of each weft insertion—even with intact weft thread—would simulate a weft break.

A triboelectrical sensing head suitable for a weft thread monitor of the present type is described, by way of example, in Swiss Pat. No. 479,478 or the corresponding U.S. Pat. No. 3,676,769.

For the sake of a more reliable indication of weft breaks and other weft faults it is advantageous to survey the weft insertion as well as the following weft tensioning phase. A weft yarn or filling thread monitor of this type is described in U.S. Pat. No. 4,228,828. Here, two separate successive sensing signals occur, one for the weft insertion and another one for the tensioning phase. Accordingly, two successive control intervals or signals are provided for the said separate sensing signals. The precise setting of these control signals, however, is rather difficult in practice because of the unavoidable fluctuations of the duration of the weft insertion and tensioning phases.

Another problem arises when the weft insertion in multicolour looms of the type in question is to be monitored. Usually, an individual sensing device is provided for each of the weft threads, and all these sensing devices are connected to a common signal circuit. Here the idle threads which are not to be inserted into the weaving shed are in contact with their individual sensing heads, so that these threads when vibrated by the operating loom may produce spurious signals. Now when the weft thread which is being inserted into the shed breaks, those spurious signals may simulate a thread travel and thus supersede the stop mechanism of the loom.

SUMMARY OF THE INVENTION

It is a primary object of the present invention to provide for an improved electronic weft thread monitor suited to gripper shuttle or projectile weaving machines.

It is a more specific object of the invention to devise a device for monitoring, on such a machine, the weft insertion or, in addition, the weft thread tensioning phase.

It is a further object of the invention to produce an electronic weft thread monitor of the aforementioned type which overcomes the deficiencies of the above-mentioned prior art devices.

These objects and others which will still become evident from the following disclosure are realized by the improvement that the sensing device comprises weft motion responsive means having a first range of high response sensitivity, and a second range of low response sensitivity, and a guide member for guiding the weft thread being deviated through the said first and second ranges of the weft motion responsive means, in a direction transverse to the longitudinal dimension of the weft thread.

A further advantageous embodiment of the inventive weft thread monitor makes it possible to survey, within a single continuous control interval, the weft insertion as well as the tensioning phases. This embodiment substantially facilitates the correct setting of the control interval, and thus the detection of weft insertion faults or deficiencies.

For the weft thread monitor, tactile as well as non-tactile sensing devices or heads may be used. Tactile sensing devices respond to motion of the weft thread in contact with the sensing device. By way of example, this type of device comprises sensors fitted with a triboelectrical, piezoelectrical, electromagnetical or electrodynamical transducer. Non-contacting or non-tactile devices comprise optoelectrical and capacitive sensors.

As stated above, the inventive sensing heads comprise two ranges of various response sensitivity: a first range of high and a second range of low or no response sensitivity. Briefly, these ranges may be termed "response range" and "dead range", respectively. The guide member is arranged such that the weft or filling thread contacts the same during the insertion of the weft thread, and guides the latter, during the tensioning and deviation phase, from the response range into the dead range. Contrary to this arrangement, all known and practically used sensing devices are designed such as to respond, during the tensioning and deviation phase, independently of the amount of deviation.

The manner of and devices for evaluating the signals produced by the mentioned types of transducers or sensing devices are prior art and not an object or subject matter of the invention. Details, e.g. of triboelectrical transducers, are described in Swiss Pat. No. 479,478 and U.S. Pat. No. 3,676,769. The evaluation of sensing signals from an optoelectrical device for monitoring travelling yarns is known, e.g. from Swiss Pat. No. 427,350.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1A:
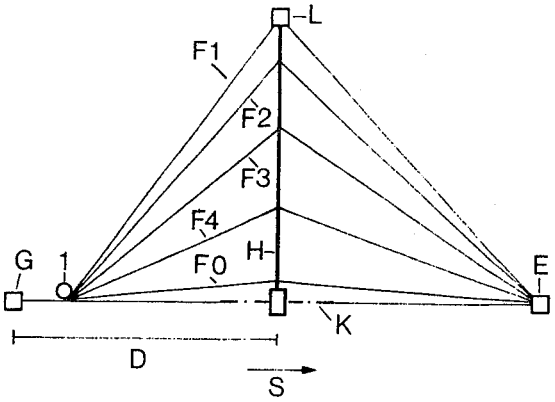
FIGS. 1*a*, 1*b* and 1*c* show a horizontally positioned guide member of a sensing device and the weft or thread path in the range of the thread tensioner having various deflections, in front, end and plan views, respectively.
Figure 1B:
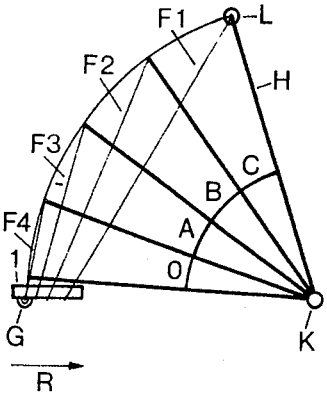
Figure 1C:
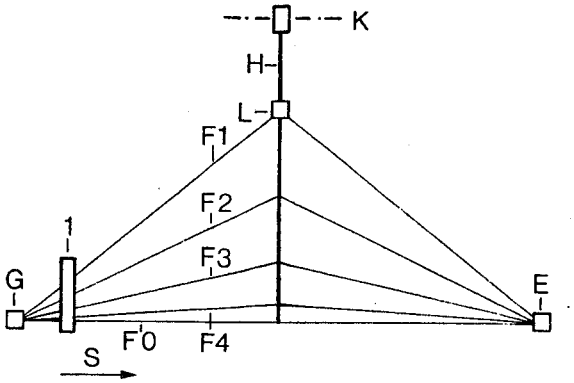
Figure 3:
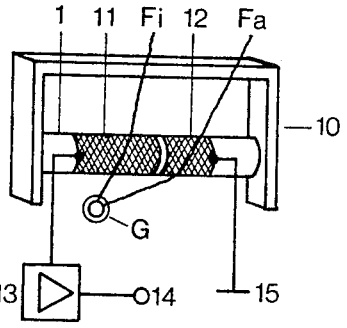
FIG. 3 depicts a first inventive embodiment of a triboelectrical sensing device.

With reference to FIGS. 1*a*, 1*b* and 1*c*, there are shown two thread guide eyes or eyelets G and E and therebetween the thread tensioner arm H of the weaving machine. The construction of a gripper shuttle weaving machine of the herein referred to type is described e.g. in Swiss Pat. No. 399,354 in connection with FIG. 1, and a thread tensioner is shown in FIG. 3.

The thread tensioner arm H is mounted pivotably about a horizontal pivot axis K and bears a thread eyelet L on its free end. The direction S of the line connecting the thread guide eyes G and E is briefly termed "shot direction", though that line need not necessarily coincide with the direction of the weft insertion.

The aforementioned parts are shown in FIG. 1*a* as viewed from the front of the weaving machine, in FIG. 1*b* in a direction from the weaving shed and against the shot direction S, and in FIG. 1*c* in top plan view.

In these Figures, various positions of the tensioner arm H and the associated paths F0,F1 through F4 of the weft or filling thread are shown. The deflection of the tensioner arm H in the lowest position is zero. When moving upward the tensioner arm H passes through the sections O,A,B and C up to the highest position.

The up-and-down motion of the tensioner arm H is controlled by the weaving machine in synchronism with the working cycle thereof in the following manner. Prior to the start of the shot the tensioner arm H has its utmost deflection—as shown by the position of the thread eyelet L in FIGS. 1*a*, 1*b*, 1*c* and 2*a*, 2*b*, 2*c*—and occupies the highest position which may be termed idle position, with the weft thread extending, in the range D between eye G and eyelet L, along the line F1. When the projectile (not shown) has seized the right end of the weft thread at a location to the right of thread eye E, the thread is inserted into the weaving shed. Just prior to the start of the shot, the tensioner arm H lowers the weft thread from the highest position F1 thereof to the lowest position F0 which is maintained up to an instant immediately prior to the end of the weft insertion. When, thereupon, the projectile is pushed back in the catch box FW, FIG. 9, of the machine, the tensioner arm H lifts or deviates the weft thread and thus keeps the same in a tensioned condition. Upon beating up the weft thread and inserting the then severed ends thereof into the cloth line, tensioner arm H is returned to the idle position thereof.

An essential feature of the sensing device is a rod-shaped guide member 1 which is shown in FIGS. 1*a*, 1*b*, 1*c* and 2*a*,2*b*, 2*c*, for the sake of clarity, without its support, casing and other parts. With reference to FIGS. 1*a*, 1*b*, 1*c*, the guide member 1 extends in a horizontal plane and at a right angle to the shot direction S, in such a position that the weft thread contacts the guide member during all of the positions of the tensioner arm H. The guide member 1 is arranged between the left thread guide eye G and a vertical plane defined by the tensioner arm H, and preferably near the left thread guide eye G. Thus, the dimensions of the guide member 1 and of the associated sensing device may be kept within practicable limits defined by the construction of the weaving machine.

As illustrated by FIG. 1*b*, the weft thread, during the deflection of the tensioner arm H, sweeps over the guide member 1 in the direction of arrow R, i.e. when viewed from the front of the weaving machine in a direction towards the rear and transverse or rectangular to shot direction S. During the insertion, the weft thread passes through the positions between FO and F4 within the deflection section O of the tensioner arm H; in this section the sweeping motion of the weft thread along the guide member 1 is to be monitored for surveying the shot. Monitoring in both following sections A and B additionally covers the tensioning phase.

Figure 2A:
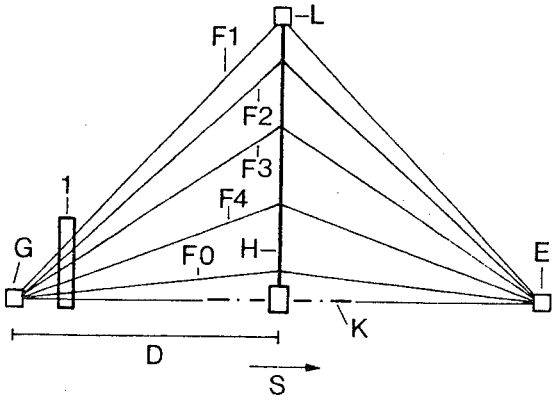
FIGS. 2*a*, 2*b* and 2*c* illustrate a vertically arranged guide member and the various weft thread paths in similar representation as shown in FIGS. 1*a*, 1*b* and 1*c*, respectively.
Figure 2B:
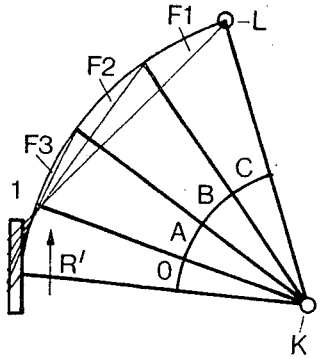
Figure 2C:
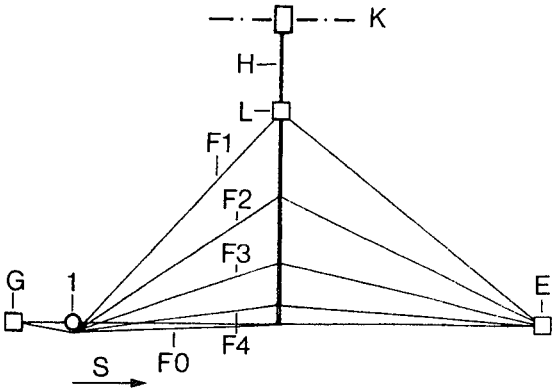

With reference to FIGS. 2*a*, 2*b*, 2*c* the guide member 1 is positioned vertically in such a manner that the weft thread contacts the guide member, during all deflections of the tensioner arm H between the lowest and highest positions thereof. When the tensioner arm H is moving up, the weft thread sweeps over the vertical guide member 1 in the direction of the perpendicular arrow R'.

As for the directions R and R' which the guide member may occupy relative to the shot direction S, the following is to be noted. According to FIGS. 1*a*, 1*b*, 1*c* and 2*a*, 2*b*, 2*c* the said directions R,R' extend at a right angle to shot direction S, and parallel or perpendicular, respectively, to the horizontal plane defined by the thread guide eyes G and E. However, the guide member 1 may also be arranged in other directions; e.g. it may form an acute angle with the shot direction S. Further, when the guide member 1 is situated in a plane perpendicular to the shot direction S, such as results from FIGS. 1*a*, 1*b*, 1*c* and 2*a*, 2*b*, 2*c*, the guide member 1 need not extend in a horizontal or vertical direction, but may occupy other directions therebetween.

With the novel sensing devices which are described in the following disclosure, the guide member has the function of guiding the weft thread, during the insertion thereof into the weaving shed and a first section of the tensioning phase which may comprise the sections A,B,C of the deflection of the tensioner arm H, in a continuous way through a first range of high response sensitivity, and a following range of low or no response sensitivity. Thus, there is ensured that the termination of the monitoring procedure and the thereby generated thread signal is exactly defined with respect to the working cycle of the weaving machine.

FIGS. 3 through 8 illustrate some exemplary embodiments of inventive sensing devices which make possible the monitoring of: firstly, the weft insertion or first phase, secondly, the weft tensioning or second phase, or thirdly, both phases together. These FIGS. 3 to 8 and the therein schematically shown structures are not to be understood as representative of the size or relations of the various zones of response of the sensing devices; for the sake of a better understanding they are drawn not to scale but such as to clearly show the principles of the thread sensing method.

Figure 9:
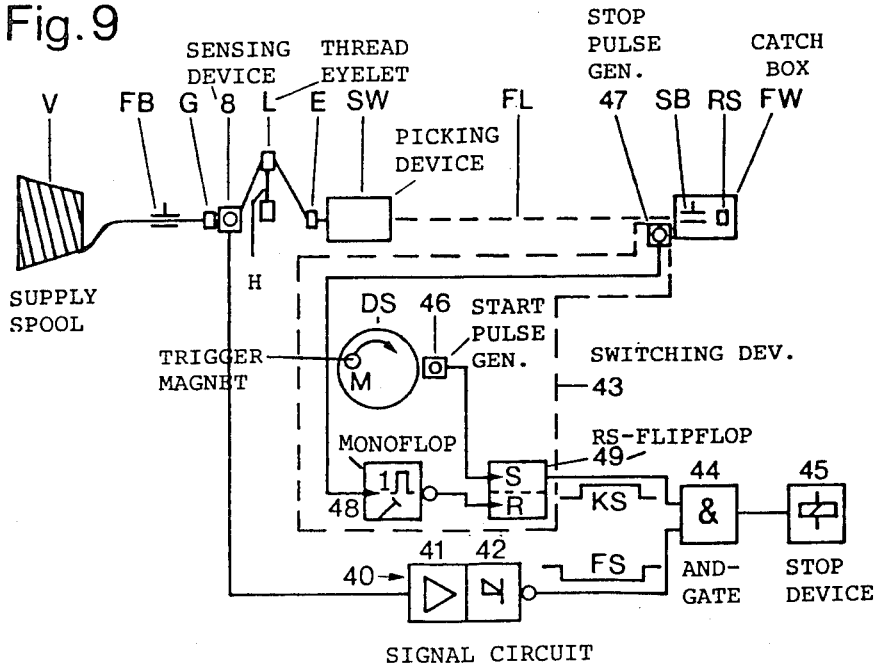
FIG. 9 is a block schematic of the inventive weft thread monitor and the therewith co-operating parts of the weaving machine.

With reference to FIG. 3 there is shown—as viewed from the catch box FW, FIG. 9, of the weaving machine—a triboelectrical sensing device 6 comprising a guide member 1 which also serves as part of a triboelectrical transducer, and a U-shaped support or bracket 10. Guide member 1 and support 10 may be mounted in a shielded casing (not shown) to be fixed at the weaving machine. The arrangement of the guide member 1 relative to the machine may be similar as represented by FIGS. 1*a*, 1*b*, 1*c* or 2*a*, 2*b*, 2*c*.

The guide member 1 consists of electrically insulating material, such as ceramics, and is shaped as a rod bearing first and second electrodes 11 and 12 on the cylindrical surface thereof, such that the rod 1 and the electrodes 11,12 form a triboelectrical transducer with the second electrode 12 being connected to ground 15. The axial extension of the electrodes 11, 12 is such that the slightly deviated weft thread Fi when passing through section O, FIG. 1*b* or 2*b*, or also sections A or A plus B, contacts the first electrode 11, whereas the strongly deviated weft thread Fa sweeps over the second electrode 12 corresponding to the section C of FIG. 1*b* or 2*b*. The first electrode 11 whose axial dimension defines a first range of high response sensitivity is connected to a signal circuit 13 for furnishing a signal at the output 14 when the weft thread Fi sweeps over the first electrode 11. The second electrode 12 is connected to ground and does not produce any thread signal, thus defining a second range of low response sensitivity or dead range.

In order to avoid wear of the electrodes 11,12 when used on the weaving machine or loom the electrode surfaces are provided with a ceramic protective layer or cover which is not particularly shown in FIG. 3 since it is unimportant with respect to the understanding of the described functions.

Figure 4:
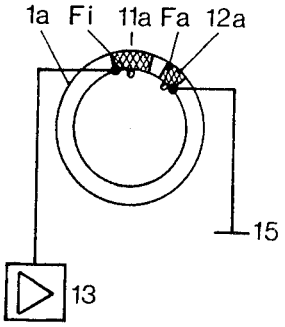
FIG. 4 depicts a second inventive embodiment of a triboelectrical sensing device.

FIG. 4 shows a ring-shaped triboelectrical transducer 7 comprising first and second electrodes 11*a*,12*a* attached to the surface of a ceramic ring 1*a*. The arrangement and function of the transducer 7 are similar as described with reference to the rod-shaped transducer illustrated in FIG. 3.

In the devices 6 and 7, FIGS. 3 and 4, the guide members 1,1*a* made of insulating material together with the electrodes 11,12 or 11*a*,12*a*, respectively, form triboelectrical transducers or weft thread sensors, and no additional guide members must be provided in these embodiments which, thus, provide for a very simple structure of the sensing devices.

Figure 5:
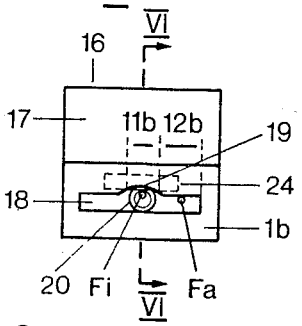
FIGS. 5 and 6 illustrate an inventive embodiment of a piezoelectrical sensing device, in end and lateral cross-sectional views, respectively.
Figure 6:
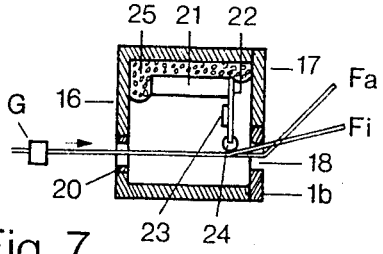

With reference to FIG. 5, there is shown a piezoelectrical sensing device 8 as viewed from the weaving shed, and FIG. 6 is a vertical cross-section of this sensing device along the line VI—VI in FIG. 5. The hollow casing 16 is covered by a front plate 17 and a guide member 1*b* having a horizontal slot 18 therein. The rear wall of casing 16 is provided with thread guide eye 20 mounted in a bore of such wall. The casing 16 houses a metal block 21 and a thereto attached piezoelectrical system comprising the components 22,23,24. A vibratable metal lamella or blade 22 is fixed to the metal block 21 and carries at its lower free end a rod-shaped friction element 24, and at one of its major faces there is fixed a flat piezoelectrical element 23. Details of the structure of such piezoelectrical sensing devices are disclosed in Swiss Pat. No. 580,533 or U.S. Pat. No. 4,110,654, by way of example.

During the weft insertion the thread Fi runs from the thread guide eye G, FIG. 6, of the weaving machine through the thread guide eye 20, over the friction element 24 and leaves the sensing device 8 through the slot 18. As a result the piezoelectrical system 22,23,24 is set into vibration and produces an electrical A.C. signal indicating thread travel.

In order to avoid transfer of mechanical vibrations or sound from the weaving machine to the piezoelectrical system 22, 23,24, and spurious signals thereby produced, the metal block 21 is embedded in a soft elastic bearing or support material 25, such as foam rubber.

As may be seen particularly from FIG. 5, the slot 18 of guide member 1*b* has an upper guide edge 19 with a bight or guide edge 11*b* in the middle thereof. In the range of the bight 11*b* the slightly deviated thread Fi contacts the friction element 24 and thus co-operates with the piezoelectrical system 22, 23,24. However, when the thread is strongly deviated as at Fa, the same is guided out of the bight 11*b* of the guide edge 19, and thus is lifted from the friction element 24 so that the thread leaves the range or zone of high response sensitivity and enters the dead range 12*b* where no signal is produced by the moving thread.

Figure 7:
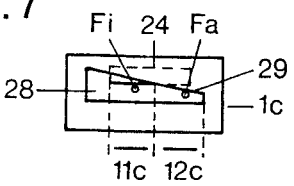
FIG. 7 illustrates a modified detail of the sensing device shown in FIG. 5.

The modified form of a guide member 1*c*, FIG. 7, has a slot 28 and a sloping rectilinear guide edge 29 which has a function similar to that of the guide member 1*b*, FIG. 5. The range of high response sensitivity is 11*c*, and the dead range 12*c*.

Figure 8:
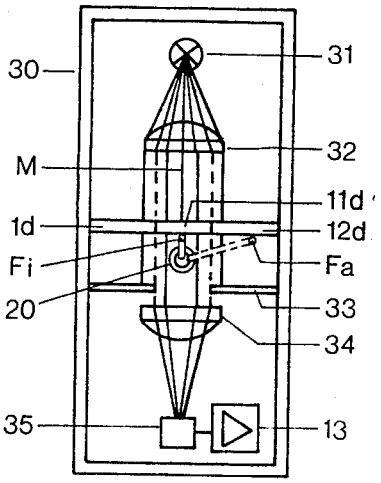
FIG. 8 illustrates an inventive optoelectrical sensing device.

FIG. 8 illustrates an optoelectrical sensing device 9 which operates without thread contact, as viewed against the shot direction S.

In the upper part of a casing 30 there is provided a light source 31 and a condenser lens 32 which directs a beam of parallel light down onto a diaphragm 33. Beneath the latter, there is arranged a second condenser lens 34 in whose focus a photosensor 35, e.g. a photodiode, is located which is connected to a signal circuit 13. Between the condenser lenses 32,34 the measuring domain M is confined whose lateral extension is limited by the diaphragm 33.

For guiding the thread Fi,Fa, a guide eye 20 is provided in the rear wall of the casing 30, i.e. at the entrance of the thread into the casing 30, and a rod-like guide member 1*d* at the front or outlet side of the thread from the casing 30. The range of high response sensitivity 11*d* of this sensing device 9 extends along the middle of guide member 1*d* and corresponds to the section O, FIG. 1*b* of slight deviation of the weft thread: that means the thread Fi here is monitored only during the weft insertion or first phase. When the strongly deviated thread Fa passes through the dead range 12*d* and thus is outside the measuring domain M, the photosensor 35 is unable to perceive the thread and to produce a sensing or thread signal.

FIG. 9 shows, in schematic representation, certain of the parts belonging to the weaving machine: a supply spool V, a thread brake FB, the fixedly mounted thread guide eyes G,E and the movable thread eyelet L of the tensioner arm H in the idle position, the picking device SW and catch box SW comprising a shuttle brake SB and push back device RS. The trajectory or flight path FL of the projectile is represented by a dashed line.

The weft thread monitor comprises a piezoelectrical sensing head or device 8, and a thereto connected signal circuit 40 comprising an amplifier 41 and a demodulator 42 in series connection. With the travelling weft thread the signal circuit 40 generates a rectangular negative going or normal thread signal FS. For producing a control signal KS shaped as a positive going rectangular pulse there is provided a switching device 43. Each of the outputs of the signal circuit 40 and switching device 43 is individually connected to one of the two inputs of an AND-gate 44 whose output controls a stop device 45 fitted with a relay.

The switching device 43 comprises two inductive pulse generators, namely a start pulse generator 46 and a stop pulse generator 47. The start pulse generator 46 determines the start, and the stop pulse generator 47, together with an adjustable monoflop 48, the end of the control signal KS. The start pulse generator 46 co-operates with a trigger magnet M attached to a rotating disc DS of the weaving machine such as to furnish a start pulse when the projectile passes the middle region of the flight path FL. The start and stop pulses control the two inputs of a RS-flipflop 49: the start pulse generator 46 sets the flipflop 49, and the rear or trailing edge of the stop pulse furnished by the monoflop 48 resets said flipflop 49. The trailing edge of the stop pulse can be varied by adjusting the monoflop 48, e.g. stepwise such as to produce stop pulses of a duration of 7,9,13,30 and 40 milliseconds. Thus, control signals KS may be generated having a fixed leading edge and various duration. In any case, the control signal KS must be adjusted such as to occur within the time interval defined by the normal thread signal FS.

When the monoflop 48 is set to produce short pulses of up to 13 milliseconds, the produced control pulses KS serve for monitoring the weft insertion or first phase. The longer control pulses of 30 and 40 milliseconds cover, in addition, the phases of pushing back the projectile by the push back device RS, and the phase of tensioning the thread by the thread tensioner arm H.

Figure 10:
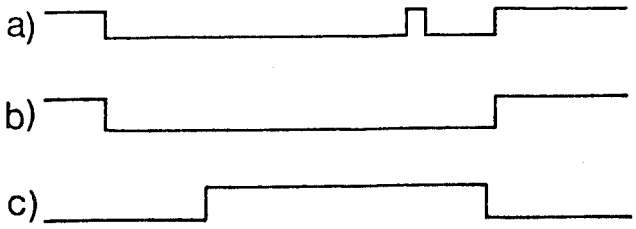
FIG. 10 depicts various signals illustrating the operational mode of the weft thread monitor represented by FIG. 9.

FIG. 10 illustrates—with reference to a prior art monitor—the novel mode of operation of the above described weft thread monitor, by means of the control and thread travel signals occurring during the operation of the weaving machine and with intact weft thread. The decisive improvement of the present monitor is the way of producing signals which make possible continuous monitoring the first and second phases up to the end of the tensioning phase. In FIG. 10 at (a) there is shown the shape of a thread travel signal as produced by the monitor described in U.S. Pat. No. 4,228,828. This signal comprises two distinctly separated pulses, namely a first pulse for the weft insertion and a second pulse for the weft tensioning phase. A similar waveform has the pertinent control signal (not shown). At (b) in FIG. 10 there is demonstrated the continuous thread travel signal furnished by the above described novel monitor: there is no gap present in this signal. At (c) the shape of the control signal is shown which is matched to the thread travel signal at (b) and which also has the form of a continuous rectangular pulse.

The sensing devices described above with reference to FIGS. 3 through 8 afford some distinct advantages over the prior art devices. In particular, it is feasible, solely by properly designing and positioning the sensing head, to delimit the range of sensitivity to any desired range or phase of the weft insertion and tensioning processes.

The coherent shape of the thread sensing signal as shown in FIG. 10 at (b) substantially facilitates the monitoring of the weft insertion and succeeding tensioning phases. The said continuous shape results from the fact that the longitudinal travel of the weft thread in the first phase steadily passes into the transverse or sweeping motion caused by the deflection of the tensioner arm H. As a consequence, the correct setting of the control signal is substantially facilitated.

The formation of the thread signal occurring in the tensioning phase and resulting from the guided transverse motion of the weft thread along the guide member is much more reliable than with the known device which makes use of the pull-after motion. Thus, a reliable monitoring of the weft insertion as well as the consecutive tensioning process now has become possible, with a single and simply constructed sensing device as designed according to the inventive principles.

In particular, all these benefits are of great weight with multicolor projectile weaving machines where an individual sensing device is provided for each of the two to six weft threads, and all the sensing heads are connected to the input of a common signal circuit. When using the described novel sensing devices on machines of this type, no spurious signals impeding the detection of a weft break can be released by idle threads which are not ready for insertion, since such threads are present in the dead range rather than the one of high response sensitivity of their associated sensing devices.

For further illustrating the co-operation of the inventive weft thread monitor with the weaving machine, the following may be noted.

The transverse or sweeping motion of the weft thread is of extreme importance for achieving reliable thread signal production. With an "acute" or close-fitted setting of the machine, in particular the thread brakes, the deflection of the tensioner arm may just be great enough to compensate for the thread length released when the projectile is pushed back, and further for stretching curled thread sections generated when the projectile is braked, and to generate a static tension of the inserted weft thread. The pull-after motion of the weft thread as mentioned above with reference to the background of the invention is not indispensable, but serves for compensating the unavoidable statistical fluctuations of the processes involved. With some shots, the pull-after motion may fail to appear, without producing weaving flaws or failures in the operation of the weaving machine. However, with the initially mentioned known monitor, wrong stoppages of the machine may be caused since that monitor makes use of the pull-after motion for generating the thread signal. On the contrary, the present inventive monitor evaluates the inevitable guided transverse or sweeping motion of the weft thread rather than the pull-after motion, and thus works independent of the fluctuations in the operation of the thread brakes.

While there are shown and described present preferred embodiments of the invention, it is to be distinctly understood that the invention is not limited thereto, but may be otherwise variously embodied and practiced within the scope of the following claims. Accordingly,

What we claim is:

1. In an electronic weft thread monitor on a gripper shuttle weaving machine provided with a picking device, a catch box with means for braking and returning, after weft thread insertion, the gripper shuttle to a defined thread releasing position, and a thread tensioner arranged between a fixed thread guide eye and the picking device and serving for deviating and tensioning the weft thread during the push back motion of the gripper shuttle, the weft thread monitor comprising a sensing device located in the region between the thread guide eye and the thread tensioner and containing means responsive to weft thread motion relative thereto during the insertion and deviation intervals, and further comprising a switching device for producing a control signal defining the time interval in which the weft thread is monitored, the improvement that the weft thread motion responsive means of said sensing device having a first range of high response sensitivity and a second range of low or no response sensitivity, and a guide member for guiding the weft thread through the said first and second ranges of the weft thread motion responsive means, in a direction transverse to the longitudinal dimension of the weft thread when deviated and tensioned by the thread tensioner.

2. In an electronic weft thread monitor on a gripper shuttle weaving machine provided with a picking device, a catch box with means for braking and returning, after weft thread insertion, the gripper shuttle to a defined thread releasing position, and a thread tensioner arranged between a fixed thread guide eye and the picking device and serving for deviating and tensioning the weft thread during the push back motion of the gripper shuttle, the weft thread monitor comprising a sensing device located in the region between the thread guide eye and the thread tensioner, a switching device for producing a control signal defining the time interval in which the weft thread is monitored, the improvement that the sensing device comprises weft motion responsive means having a first range of high response sensitivity and a second range of low response sensitivity, and a guide member for guiding the weft thread being deviated through the said first and second ranges of the weft motion responsive means, in a direction transverse to the longitudinal dimension of the weft thread, the guide member and the weft motion responsive means forming an integral structure, and the said first and second ranges of high and low response sensitivity, respectively, are formed by first and second electrodes attached to the guide member.

3. In an electronic weft thread monitor on a gripper shuttle weaving machine provided with a picking device, a catch box with means for braking and returning, after weft thread insertion, the gripper shuttle to a defined thread releasing position, and a thread tensioner arranged between a fixed thread guide eye and the picking device and serving for deviating and tensioning the weft thread during the push back motion of the gripper shuttle, the weft thread monitor comprising a sensing device located in the region between the thread guide eye and the thread tensioner, a switching device for producing a control signal defining the time interval in which the weft thread is monitored, the improvement that the sensing device comprises weft motion responsive means having a first range of high response sensitivity and a second range of low response sensitivity, and a guide member for guiding the weft thread being deviated through the said first and second ranges of the weft motion responsive means, in a direction transverse to the longitudinal dimension of the weft thread, the guide member and the weft motion responsive means forming separate structures, and the guide member comprising a guide edge having first and second sections for guiding the weft thread into and out of contact, respectively, with the weft motion responsive means.

4. In an electronic weft thread monitor on a gripper shuttle weaving machine provided with a picking device, a catch box with means for braking and returning, after weft thread insertion, the gripper shuttle to a defined thread releasing position, and a thread tensioner arranged between a fixed thread guide eye and the picking device and serving for deviating and tensioning the weft thread during the push back motion of the gripper shuttle, the weft thread monitor comprising a sensing device located in the region between the thread guide eye and the thread tensioner, a switching device for producing a control signal defining the time interval in which the weft thread is monitored, the improvement that the sensing device comprises weft motion responsive means having a first range of high response sensitivity and a second range of low response sensitivity, and a guide member for guiding the weft thread being deviated through the said first and second ranges of the weft motion responsive means, in a direction transverse to the longitudinal dimension of the weft thread, the sensing device comprises a thread guide eye, a tactile motion responsive member, and said guide member, the said members of said sensing device extending in a direction transverse to the longitudinal dimension of the weft thread, the guide member comprising a guide edge having first and second sections for guiding the weft thread into and out of contact, respectively, with the tactile motion responsive member.

* * * * *